US006374839B2

(12) United States Patent
Patarra

(10) Patent No.: US 6,374,839 B2
(45) Date of Patent: Apr. 23, 2002

(54) PORTABLE COOLER APPARATUS WITH UMBRELLA MOUNTING MEANS

(76) Inventor: Samuel F. Patarra, 111 Elysium Dr., Royal Palm Beach, FL (US) 33441

( * ) Notice: Subject to any disclaimer, the term of this patent is extended or adjusted under 35 U.S.C. 154(b) by 0 days.

(21) Appl. No.: 09/726,189

(22) Filed: Nov. 29, 2000

Related U.S. Application Data

(63) Continuation-in-part of application No. 09/317,301, filed on May 24, 1999, now Pat. No. 6,199,570.

(51) Int. Cl.[7] ..... A45B 3/00
(52) U.S. Cl. ..... 135/16
(58) Field of Search ..... 135/16, 20.3; 62/457.7; 52/155

(56) References Cited

U.S. PATENT DOCUMENTS

| | | | | | |
|---|---|---|---|---|---|
| 892,813 | A | | 7/1908 | Dolles | |
| 4,832,163 | A | | 5/1989 | Levesque | |
| 5,143,108 | A | | 9/1992 | Kenney | |
| 5,259,215 | A | * | 11/1993 | Rocca | 62/457.7 |
| 5,269,157 | A | * | 12/1993 | Ciminelli | 62/457.7 |
| 5,275,018 | A | * | 1/1994 | Lin | 62/457.7 |
| 5,373,708 | A | * | 12/1994 | Dumoulin | 62/457.7 |
| 5,407,218 | A | * | 4/1995 | Jackson | 62/457.7 |
| 5,823,213 | A | | 10/1998 | Patarra | |
| 6,199,569 | B1 | * | 3/2001 | Gibson | 135/16 |
| 6,199,570 | B1 | * | 3/2001 | Patarra | 135/16 |
| 6,216,488 | B1 | * | 4/2001 | Rucker | 62/457.7 |

FOREIGN PATENT DOCUMENTS

| | | |
|---|---|---|
| FR | 2 606 063 | 6/1988 |
| FR | 2 678 977 | 1/1993 |

* cited by examiner

*Primary Examiner*—Beth A. Stephan
(74) *Attorney, Agent, or Firm*—Oltman, Flynn & Kubler

(57) ABSTRACT

A container apparatus for use in combination with an umbrella having an umbrella mast and umbrella canopy includes a food container having a container top wall, a container side wall and a container bottom wall together defining a container interior, with an umbrella mast passing port, a mast engaging structure, and a container interior access door; so that the umbrella mast of may be inserted into the mast passing port and advanced into the interior of the container and engaged by the mast engaging structure, thereby holding the umbrella mast upright relative to the container and so that the container stabilizes the umbrella, which can be opened over the container. The container preferably is insulated against heat transfer between the container interior and the surrounding environment and the container top wall preferably is substantially horizontal when the container is upright and thereby functions as a table upon which a user can place food and drink items. The apparatus preferably additionally includes a pull handle on the container and at least one wheel rotatably mounted onto the container substantially opposite the pull handle so that the container wheel rolls on the ground as the pull handle is pulled by a user. The apparatus preferably still further includes a container stabilizing mechanism for keeping the umbrella from overbalancing the container and causing the container to tip over when the apparatus rests on a granular surface.

11 Claims, 3 Drawing Sheets

PORTABLE COOLER APPARATUS WITH UMBRELLA MOUNTING MEANS

FILING HISTORY

This application is a continuation-in-part of application Ser. No. 09/317,301 filed on May 24, 1999 now U.S. Pat. No. 6,199,570.

BACKGROUND OF THE INVENTION

1. Field of the Invention

The present invention relates generally to the field of heat insulated food containers commonly known as coolers. More specifically the present invention relates to a portable cooler apparatus including a food container which is preferably insulated against heat transfer with the surrounding environment, the container having a container top wall, a container side wall and a container bottom wall preferably formed integrally with the container side wall, the container top wall having an umbrella mast passing port and the container bottom wall having mast engaging means, such that the mast of an umbrella can be inserted into the mast passing port and advanced into the container interior and engaged by the mast engaging means, thereby holding the umbrella upright relative to the container, and a container interior access door. The container acts as a stabilizing base for the umbrella, which can be opened over the container, and the container top wall preferably functions as a table on which the user can place food and drink items for consumption. A pull handle is preferably provided on the container side wall and a pair of wheels are preferably secured to the lower end of the container side wall opposite the pull handle so that the container can be pulled conveniently to its destination.

2. Description of the Prior Art

There previously have been beach umbrellas having umbrella masts structurally combined with various containers. Patarra, U.S. Pat. No. 5,823,213, issued on Oct. 20, 1998 discloses a combination purse and umbrella in which the umbrella canopy collapses around a purse container at the base of the umbrella mast. Kenney, U.S. Pat. No. 5,143,108, issued on Sep. 1, 1992 teaches a beach umbrella having secured to its mast several rotatable utility compartments for storing beach equipment and having a base end stake for penetrating the ground. Dolles, U.S. Pat. No. 892,813, issued on Jul. 7, 1908 reveals a folding umbrella in which the handle at the base of the mast is tubular and serves as a receptacle for the folded body of the umbrella. Levesque, U.S. Pat. No. 4,832,163, issued on May 23, 1989, discloses a portable table system including a pair of semicylindrical containers secured face to face to define a complete cylinder which receives the mast of an umbrella and the upper surface of which functions as a table top. French patent number 91 09008/2 678 977 filed on Jul. 10 1991 by Guetta teaches a portable container which may be insulated, and having a vertical tubular member securely attached to and passing at least partly through the container for receiving the lower end of an umbrella mast. French patent 86 15303/2 606 063 filed on Oct. 31, 1986 by Rombi reveals a sunshade supporting water container made up of two semicircular container halves hinged together along their lateral edges, each having a central longitudinal channel, for placing face to face to receive in the opposing channels the mast of an umbrella. Problems with all of these prior devices include that they do not provide a unified umbrella and ground piercing pointer which is removable from the container and do not provide wheel and handle transport means.

It is thus an object of the present invention to provide a container apparatus which is designed to receive and hold upright the mast of an umbrella such as a beach umbrella.

It is another object of the present invention to provide such an apparatus in which the container is heat insulated to function as a cooler for food items and the container upper wall functions as a table for placement of the food items during consumption of the food items.

It is still another object of the present invention to provide such an apparatus which is readily portable without lifting, including a pull handle and wheels, and from which the umbrella can be quickly and easily removed without tools.

It is finally an object of the present invention to provide such an apparatus which is simple in design, durable, easy to use and relatively inexpensive to manufacture.

SUMMARY OF THE INVENTION

The present invention accomplishes the above-stated objectives, as well as others, as may be determined by a fair reading and interpretation of the entire specification.

A container apparatus is provided for use in combination with an umbrella having an umbrella mast and umbrella canopy, including a food container having a container top wall, a container side wall and a container bottom wall together defining a container interior, with an umbrella mast passing port, a mast engaging structure, and a container interior access door; so that the umbrella mast may be inserted into the mast passing port and advanced into the interior of the container and engaged by the mast engaging structure, thereby holding the umbrella mast upright relative to the container and so that the container stabilizes the umbrella, which can be opened over the container.

The container preferably is insulated against heat transfer between the container interior and the surrounding environment. The container bottom wall preferably is integral with the container side wall. The container top wall preferably is substantially horizontal when the container is upright and thereby functions as a table upon which a user can place food and drink items. The apparatus preferably additionally includes a pull handle on the container and at least one wheel rotatably mounted onto the container substantially opposite the pull handle so that the container wheel rolls on the ground as the pull handle is pulled by a user. The container may be a substantially rectangular box.

The mast engaging structure preferably includes a mast securing fitting connected to the container bottom wall which includes an annular flange having an upright tubular segment for receiving the lower end of the umbrella mast. The apparatus preferably additionally includes a mast retaining tube extending from the mast engaging structure to the mast passing port in the container top wall.

The apparatus preferably still further includes a container stabilizing mechanism for keeping the umbrella from overbalancing the container and causing the container to tip over when the apparatus rests on a granular surface. The stabilizing mechanism preferably includes a pointer removably secured to the lower end of the umbrella mast; and a pointer passing port in the container bottom wall for passing the pointer completely through the container so that the pointer projects downwardly out of the container bottom wall and into the granular surface. The apparatus preferably additionally includes a depth marking line on the umbrella mast for indicating a suggested pointer insertion depth when the depth marking line registers with another part of the apparatus.

The pointer preferably includes a shaft having substantially the same diameter as the umbrella mast and has a pointer lower end which is tapered for lower resistance penetration into the ground. The pointer has a pointer upper end, and the pointer upper end preferably has an upwardly protruding, axial, externally threaded pointer bolt portion having a smaller diameter than the diameter of the umbrella mast; and the mast lower end has an internally threaded axial mast bore for threadedly receiving the pointer bolt portion to removably connect the pointer to the umbrella mast. The apparatus preferably still further includes a port closing door underneath the pointer passing port, such that the pointer passing port can be closed to prevent mast passage.

The container top wall preferably includes a top wall fixed section secured to the container side wall and includes the mast passing port. Wherein the top wall fixed section preferably includes an elongate diametric strip passing over the middle of the container and connected to the container side wall at opposing points of the container side wall, the apparatus preferably additionally includes a container lid defining the remainder of the container top wall and closing the container. Where the top wall fixed section is a diametric strip, the first and second container lids are pivotally secured to opposing sides of the top wall fixed section with hinges and extend from the top wall fixed section in opposite directions to meet upper end segments of the container side wall, thereby completing the container top wall and closing the container.

A container and umbrella apparatus is provided, including an umbrella having an umbrella mast and umbrella canopy; a food container having a container top wall, a container side wall and a container bottom wall together defining a container interior, with an umbrella mast passing port mast engaging structure, and a container interior access door; so that the umbrella mast may be inserted into the mast passing port and advanced into the interior of the container and engaged by the mast engaging structure, thereby holding the umbrella mast upright relative to the container and so that the container stabilizes the umbrella, which can be opened over the container.

The umbrella mast preferably includes a mast upper segment; and a mast lower segment separate from the mast upper segment, the mast lower segment being tubular and sized so that the mast upper segment telescopingly fits into the mast lower segment to produce any of a variety of overall mast heights as desired by the individual user; a cam lever locking mechanism for releasibly locking the mast upper segment against movement relative to the mast lower segment at the desired telescoping position.

The upper end of the mast lower segment preferably includes a cam lever opening and the cam lever locking mechanism preferably includes a cam lever having an elongate lever end for gripping and moving by hand and having a cam end perforated by a fulcrum pin port and which fits into the cam lever opening in the mast lower segment and includes a cam lever pin passing through the mast lower segment upper end, through the cam lever opening and through the fulcrum pin port in the cam lever, so that the cam lever pivots within the cam lever opening and the cam end progressively protrudes into the interior of the mast lower segment to varying degrees as the cam lever is pivoted and thus progressively bears against and grips the mast upper segment.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
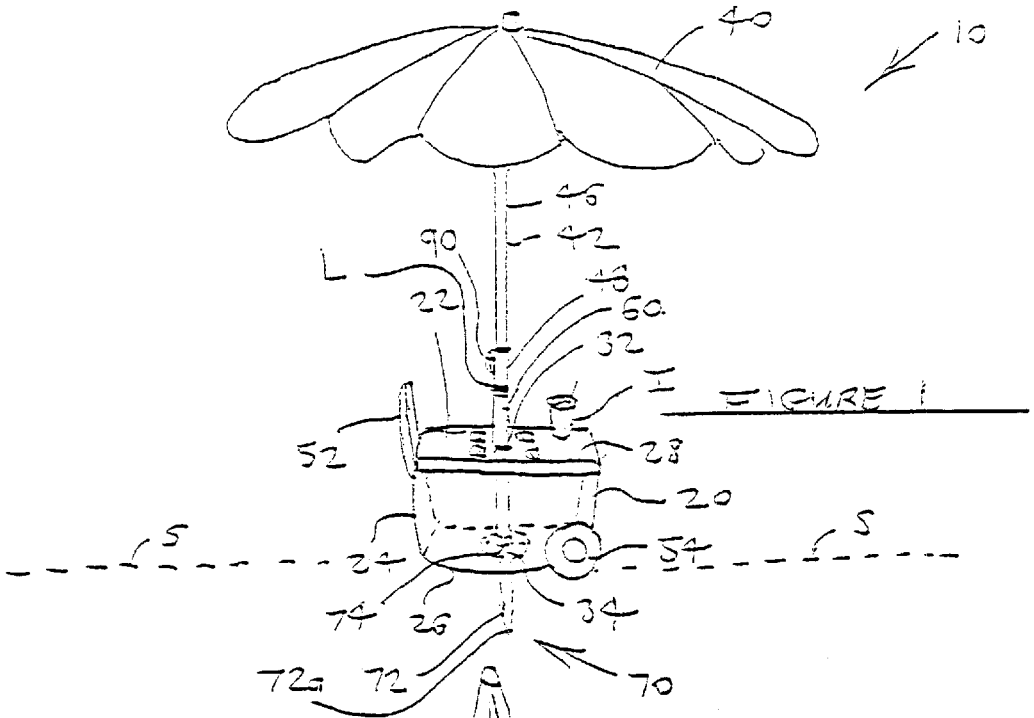
FIG. 1 is a perspective view of the preferred embodiment of the apparatus, shown with the umbrella canopy open, and revealing in broken lines the interior of the container and the pointer protruding downwardly into a granular support surface. A beverage glass is shown on top of the container top wall.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMDODIMENT

Figure 2:
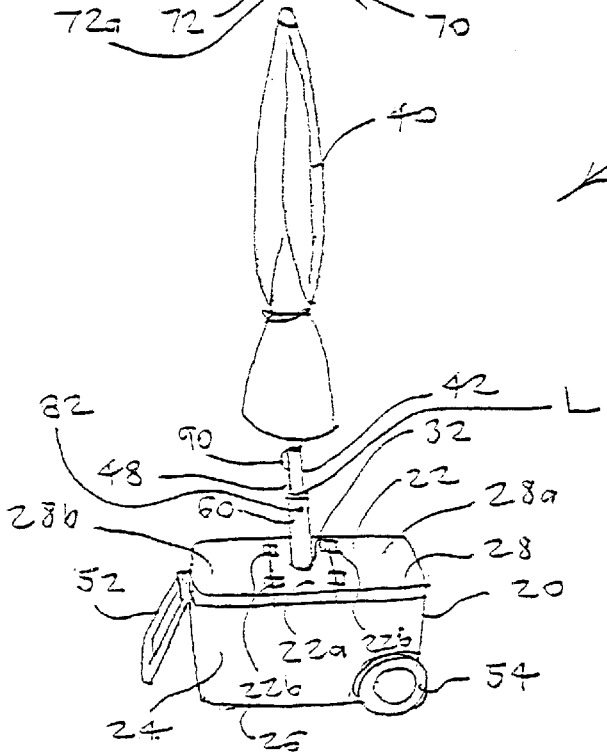
FIG. 2 is a view generally as in FIG. 1 with the umbrella canopy closed and the pointer omitted.
Figure 3:
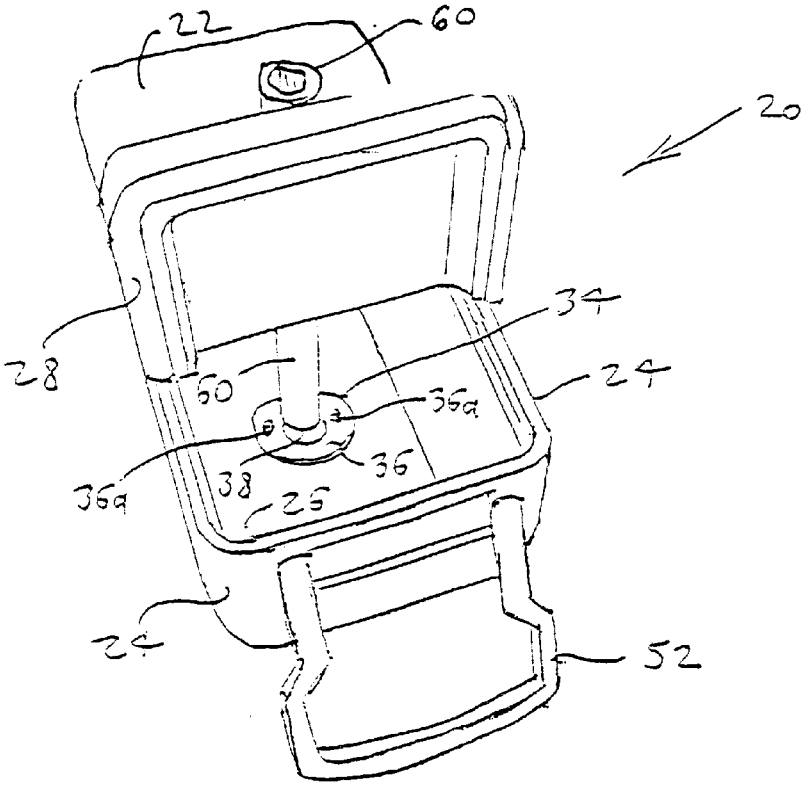
FIG. 3 is a top perspective view of the apparatus container with one of the two opposing lids open, revealing the lower segment of the mast retaining tube and the mast engaging means.
Figure 4:
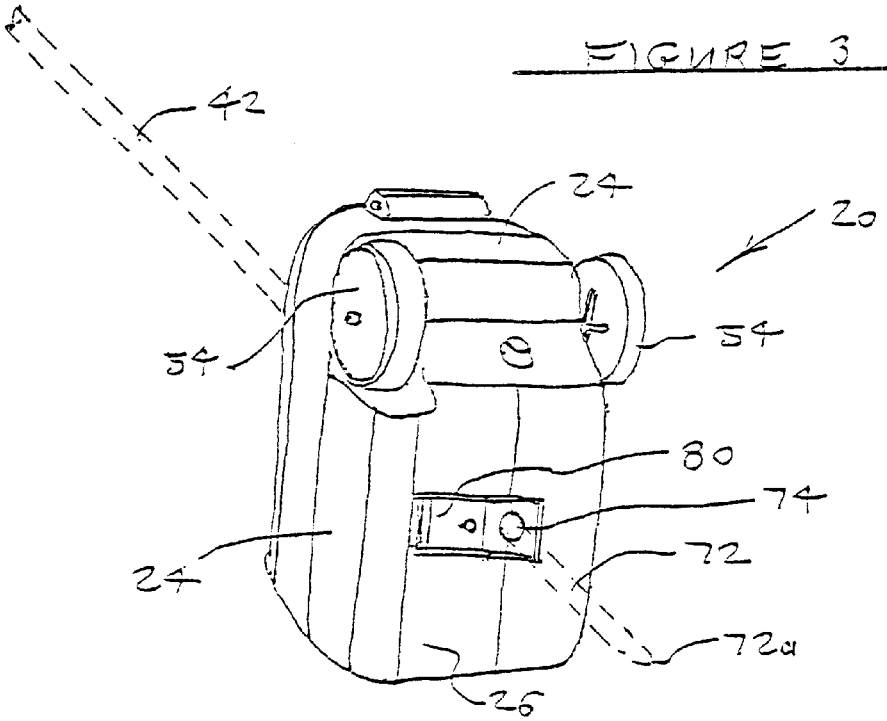
FIG. 4 is a bottom perspective view of the apparatus container, showing the mast passing port in the container bottom wall with a one piece mast shown in broken lines passing through the container and the pointer portion extending out of the bottom of the container through the mast passing port. An interior access door is shown in its open position adjacent the mast passing port which is slidable on parallel tracks.
Figure 5:
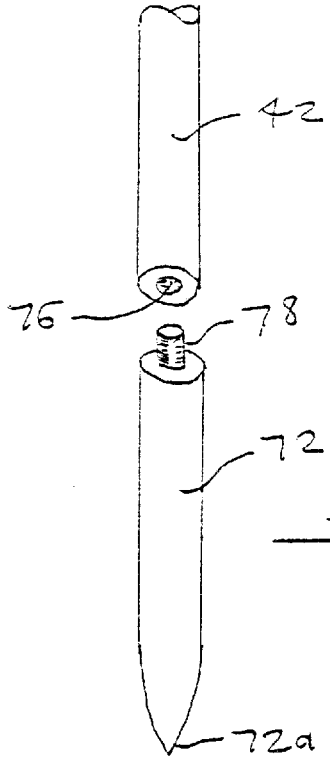
FIG. 5 is a broken away perspective view of the pointer and the mast lower segment lower end, showing the externally threaded pointer bolt portion positioned for engaging insertion into the internally threaded axial mast bore.
Figure 6:
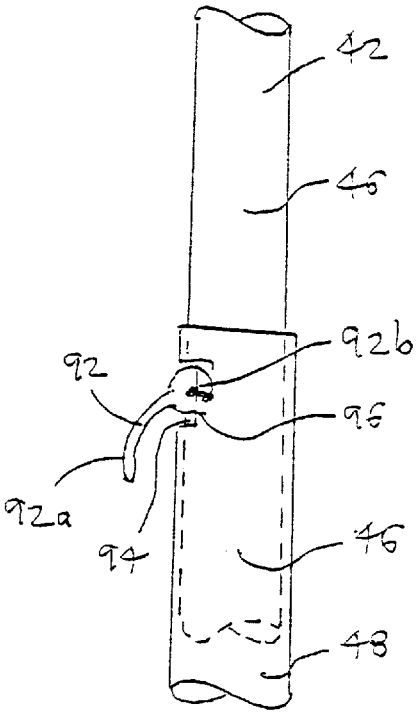
FIG. 6 is a broken away side view of telescoping upper and lower mast segments, and of the cam lever locking mechanism, showing details of the cam lever as its cam end bears against and engages the mast upper segment.

Referring to FIGS. 1–6, a cooler apparatus 10 is disclosed including a food container 20 which is preferably insulated against heat transfer with the surrounding environment, the container 20 having a container top wall 22, a container side wall 24 and a container bottom wall 26 preferably formed integrally with container side wall 24, the container top wall 22 having an umbrella mast passing port 32 and the container bottom wall 26 having mast engaging means 34, such that the mast 42 of an umbrella 40 can be inserted into the mast passing port 32 and advanced into the container 20 interior and engaged by the mast engaging means 34, thereby holding the umbrella 40 upright relative to the container 20, and the container 20 further having a container interior access door 28. Container 20 acts as a stabilizing base for the umbrella 40, which can be opened over container 20, and the container top wall 22 preferably functions as a table on which the user can place food and drink items I for consumption.

A pull handle 52 is preferably provided on the container side wall 24 and a pair of wheels 54 are preferably secured to the lower end of the container side wall 24 opposite the pull handle 52 so that the container 20 can be pulled conveniently to its destination. An example of a suitable container 20 is a wheeled cooler made by COLEMAN™. Container 20 may be a rectangular box, or may take any other suitable configuration. The optional container 20 insulation may be provided by a conventional double wall containing an air gap, or by fabrication from an insulating foam.

The mast engaging means 34 preferably includes a mast securing fitting in the form of an annular flange 36 having an upright tubular segment 38 for receiving the mast 42. See FIG. 3. Screw fasteners 36*a* preferably pass through annular flange 36 and into the container bottom wall 26. It is preferred that a mast retaining tube 60 be secured to and extend from the mast engaging means 34 through the mast passing port 32 in the container top wall 22, and protrude a certain distance above container top wall 22.

Stabilizing means 70 are added to keep the umbrella 40 from overbalancing the apparatus 10 and tipping it over on a sand or soil surface S. Stabilizing means 70 include a spike or pointer 72 which is removably secured to the mast 42 lower end, and a pointer passing port 74 in the container bottom wall 26 at the location of the mast engaging means 34 for passing the pointer 72 completely through container 20 so that pointer 72 projects downwardly and out of the container bottom wall 26 and into the sand or soil. A set screw 82 is preferably screwed radially into and through a threaded retaining tube 60 set screw port to either abut and frictionally engage the umbrella mast 42 or to screw into a registering, threaded umbrella 42 mast port to releasibly retain the umbrella mast 42 within retaining tube 60. A depth marking line L is provided on the mast 42 which indicates the optimum pointer 72 insertion depth when the depth marking line L registers with the upper edge of the mast retaining tube 60, or where tube 60 is omitted, with the upper edge of the mast passing port 32 in the container top wall 22. When the depth marking line L thus registers, the pointer 72 is fully inserted into the ground. The pointer 72 preferably is a shaft having the same diameter as the umbrella mast 42 and has a pointed lower end 72*a*. The pointer 72 upper end has an upwardly protruding, axial, externally threaded pointer bolt portion 78 of smaller diameter than the mast 40 at the pointer 72 upper end, and the mast 40 lower end has an internally threaded axial mast bore 76 to threadedly receive the pointer bolt portion 78 to removably connect the pointer 72 to the mast 40. A port closing door 80 is preferably provided underneath the pointer passing port 74, so that the pointer passing port 74 can be closed to prevent mast 40 passage.

The umbrella 40 may be of conventional construction, and may be purchased separately from the apparatus 10 from an existing line of outdoor or beach umbrellas. Alternatively, the umbrella 40 may be of the general design disclosed in U.S. Pat. No. 5,823,213 issued on Oct. 20, 1998 to the present applicant.

The umbrella mast 42 optionally includes a mast upper segment 46 and a separate mast lower segment 48, which are tubular and sized so that the mast upper segment 46 telescopingly fits into the mast lower segment 48 to any of a variety of overall mast 40 lengths heights as desired by the individual user and as dictated by the circumstances of the given use. A cam lever locking mechanism 90 is preferably provided to releasibly lock the mast upper segment 46 against movement relative to the mast lower segment 48 at any desired telescoping position. See FIG. 6. Cam lever locking mechanism 90 includes a cam lever 92 has an elongate lever end 92*a* for gripping and moving by hand and has a cam end 92*b* perforated by a fulcrum pin port and which fits into a cam lever opening 94 in the mast lower segment upper end. A cam lever pin 96 passes through the mast lower segment 48 upper end, through the cam lever opening 94 and through the aligned fulcrum pin port in the cam end 92*b*, so that the cam lever 92 pivots within the cam lever opening 94 and the cam end 92*b* progressively protrudes into the interior of the mast lower segment 48 to varying degrees as the cam lever 92 is pivoted. The mast upper segment 46 is fitted into the mast lower segment 48 when the cam lever 92 is pivoted to a position at which the cam end 92*b* protrudes either not at all or minimally into the mast lower segment 48 interior, and when the mast upper segment 46 is telescoped to its desired position relative to the mast lower segment 48, the cam lever 92 is pivoted to protrude progressively further into the mast lower segment 48 interior to abut the mast upper segment 46 with progressive force until a firm friction engagement with the mast upper segment 46 is achieved. The mast upper segment 46 is subsequently released by pivoting the cam lever 92 in the opposite direction.

Pointer 72 is described above as a detachable element from mast 42. Yet it is also contemplated that pointer 72 may be an integral part of umbrella mast 42. Where umbrella mast 42 has a detachable upper and lower mast segments 46 and 48, a lower mast segment 48 having no pointer 72 portion is provided for use on solid surfaces and a second lower mast segment 48 having an integral pointer 72 is provided for use on granular support surfaces. See FIG. 4. Still alternatively, mast 42 may be provided as a single integral piece including pointer 72.

The container top wall 22 preferably includes a top wall fixed section 22*a* secured to the container side wall 24 includes the mast passing port 32. The top wall fixed section 22*a* is preferably an elongate diametric strip passing over the middle of container 20 and secured to or integrally formed with the container side wall 24 at opposing points of the side wall 24. Container lid 28 forms the remainder of the container top wall 22 and closes the container 20. Where the fixed section 22*a* is a diametric strip, first and second container lids 28*a* and 28*b*, respectively, are pivotally secured to opposing sides of the fixed section 22*a* with hinges 22*b* and extend from the fixed section 22*a* in opposite directions to meet the side wall 24, thereby completing container top wall 22 and closing the container 20.

Method

When apparatus 10 is to be used on a hard or paved surface, the port closing door 80 is closed and the pointer 72 is removed from the mast 40. Then the mast 40 is fitted through the mast passing port 74 and into the mast engaging means 34, so that the mast 40 lower end abuts and is supported by port closing door 80. When apparatus 10 is to be used on a sand or soil surface S, the port closing door 80 is preferably opened and the pointer 72 attached to the mast 40, as described. When container 20 is in its desired location for use, the combined pointer 72 and mast 40 are slid downwardly through the mast passing port 32 and the pointer 72 is slid further downwardly through the pointer passing port 74 and into the ground until the depth marking line L registers with the upper edge of the mast passing port 32.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A container apparatus for use in combination with an umbrella having an umbrella mast and umbrella canopy, comprising:

a food container having a container top wall, a container side wall and a container bottom wall together defining a container interior, with an umbrella mast passing port, mast engaging means, and a container interior access door;

such that the umbrella mast may be inserted into said mast passing port and advanced into the interior of said container and engaged by said mast engaging means, thereby holding the umbrella mast upright relative to said container and such that said container stabilizes the umbrella, which can be opened over said container;

wherein said mast engaging means comprises a mast securing fitting connected to said container bottom wall which includes an annular flange having an upright tubular segment for receiving the lower end of said umbrella mast.

2. A container apparatus for use in combination with an umbrella having an umbrella mast and umbrella canopy, comprising:

a food container having a container top wall, a container side wall and a container bottom wall together defining a container interior, with an umbrella mast passing port, mast engaging means, and a container interior access door;

container stabilizing means for keeping the umbrella from overbalancing said container and causing said container to tip over when said apparatus rests on a granular support surface;

such that the umbrella mast may be inserted into said mast passing port and advanced into the interior of said container and engaged by said mast engaging means, thereby holding the umbrella mast upright relative to said container and such that said container stabilizes the umbrella, which can be opened over said container;

wherein said stabilizing means comprises:

a pointer removably secured to the lower end of said umbrella mast;

and a pointer passing port in said container bottom wall for passing said pointer completely through said container such that said pointer projects downwardly out of said container bottom wall and into the granular support surface.

3. The apparatus of claim 2, additionally comprising a depth marking line on said mast for indicating a suggested pointer insertion depth when said depth marking line registers with another part of said apparatus.

4. The apparatus of claim 2, wherein said pointer comprises a shaft having substantially the same diameter as the umbrella mast and has a pointer lower end which is tapered for lower resistance penetration into the ground.

5. The apparatus of claim 2, wherein said pointer has a pointer upper end, and said pointer upper end has an upwardly protruding, axial, externally threaded pointer bolt portion having a smaller diameter than the diameter of the umbrella mast;

and wherein the mast lower end has an internally threaded axial mast bore for threadedly receiving said pointer bolt portion to removably connect said pointer to said umbrella mast.

6. The apparatus of claim 2, additionally comprising a port closing door underneath the pointer passing port, so that the pointer passing port can be closed to prevent mast passage.

7. A container apparatus for use in combination with an umbrella having an umbrella mast and umbrella canopy, comprising:

a food container having a container top wall, a container side wall and a container bottom wall together defining a container interior, with an umbrella mast passing port, mast engaging means, and a container interior access door;

such that the umbella mast may be inserted into said mast passing port and advanced into the interior of said container and engaged by said mast engaging means, thereby holding the umbrella mast upright relative to said container and such that said container stabilizes the umbrella, which can be opened over said container;

wherein said container top wall comprises a top wall fixed section secured to said container side wall and includes said mast passing port;

wherein said top wall fixed section comprises an elongate diametric strip passing over the middle of said container and connected to said container side wall at opposing points of said container side wall, additionally comprising a container lid defining the remainder of said container top wall and closing said container.

8. The apparatus of claim 7, wherein said top wall fixed section is a diametric strip, and wherein first and second said container lids are pivotally secured to opposing sides of said top wall fixed section with hinge means and extend from said top wall fixed section in opposite directions to meet upper end segments of said container side wall, thereby completing said container top wall and closing said container.

9. A container and umbrella apparatus, comprising:

an umbrella having an umbrella mast and umbrella canopy;

a food container having a container top wall, a container side wall and a container bottom wall, with an umbrella mast passing port mast engaging means, and a container interior access door;

and container stabilizing means for keeping the umbrella from overbalancing said container and causing said container to tip over when said apparatus rests on a granular support surface, said stabilizing means comprising a pointer secured to the lower end of said umbrella mast; and a pointer passing port in said container bottom wall for passing said pointer completely through said container such that said pointer projects downwardly out of said container bottom wall and into the granular support surface;

such that the umbrella mast may be inserted into said mast passing port and advanced into the interior of said container and engaged by said mast engaging means, thereby holding the umbrella mast upright relative to said container and such that said container stabilizes the umbrella, which can be opened over said container.

10. The apparatus of claim 9, wherein said pointer is integral with said umbrella mast.

11. The apparatus of claim 9, wherein said pointer is removably secured to said umbrella mast.

* * * * *